US006149349A

United States Patent [19]

Nikiforuk et al.

[11] Patent Number: 6,149,349

[45] Date of Patent: Nov. 21, 2000

[54] APPARATUS AND METHOD FOR EXTRACTING AND REPLACING BURIED PIPE

[76] Inventors: Nick Nikiforuk; Nick C. Nikiforuk, both of R.R. 6 Box 242, Edmonton, Alberta, Canada, T5B 4K3

[21] Appl. No.: 09/172,291

[22] Filed: Oct. 14, 1998

[51] Int. Cl.[7] ..... E02F 5/10; B63B 35/03

[52] U.S. Cl. ..... 405/184; 405/154; 175/53; 175/62; 254/29 R

[58] Field of Search ..... 405/154, 184; 175/53, 62

[56] References Cited

U.S. PATENT DOCUMENTS

| | | | |
|---|---|---|---|
| 3,008,528 | 11/1961 | Berthet et al. | 175/55 |
| 3,874,532 | 4/1975 | Metailler | 214/138 |
| 4,006,521 | 2/1977 | Pedone | 29/282 |
| 4,060,992 | 12/1977 | Heitkamp et al. | 405/212 |
| 4,063,428 | 12/1977 | Waas | 405/283 |
| 4,368,873 | 1/1983 | Perry | 254/29 R |
| 4,626,198 | 12/1986 | Coumont et al. | 405/184 |
| 5,205,671 | 4/1993 | Handford | 405/154 |
| 5,211,509 | 5/1993 | Roessler | 405/184 |
| 5,328,297 | 7/1994 | Handford | 405/184 |
| 5,672,029 | 9/1997 | Boyer | 405/154 |
| 5,782,311 | 7/1998 | Wentworth | 405/184 X |
| 5,913,639 | 6/1999 | Ellis | 405/184 |

*Primary Examiner*—Eileen D. Lillis
*Assistant Examiner*—Jong-Suk Lee
*Attorney, Agent, or Firm*—Millen, White, Zelano & Branigan, P.C.

[57] ABSTRACT

A pipe/pulling frame is fitted to the tool end of a movable boom of an excavator, preferably via a quick-attach coupling. The boom first positions the frame in and out of the pit and then secondly holds the frame against twisting movement in the pipe-extraction pit during pulling, thereby obviating the need to provide shoring and other bracing. The frame comprises an actuator and a single reaction plate. The actuator pulls a segmented cable which extends through the pipe while the reaction plate structure bears against the pit wall. The actuator is further operable also to push a stuck pipe, for which the reaction structure is moved to the opposing end of the frame. A swivel is preferably fitted between the tool end and frame to allow the excavator to be positioned independent of the frame. An abutment member at the distal end of the old pipe is replaceable with a ground-reaming tubular pipe for pushing the trailing end of the old pipe and pulling the leading end of a new pipe. The quick-attach coupling at the tool end accepts an excavation bucket to dig the pits, the frame for pulling the pipe, and a ripper tooth to rapidly pull lengths of old pipe from the ground once the force needed falls off.

9 Claims, 9 Drawing Sheets

FIG. 5a
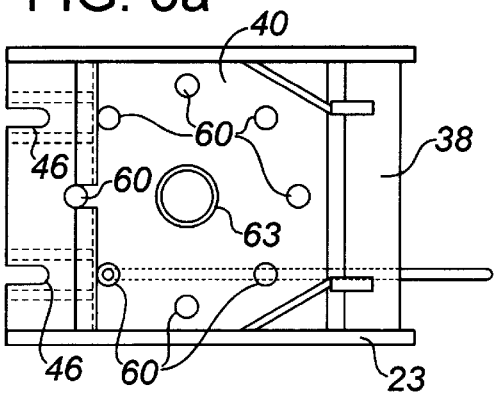
FIG. 6a
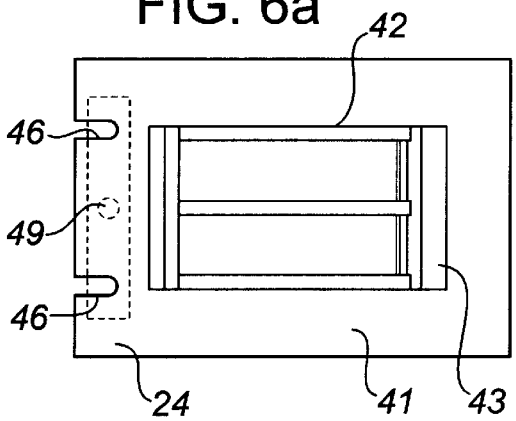
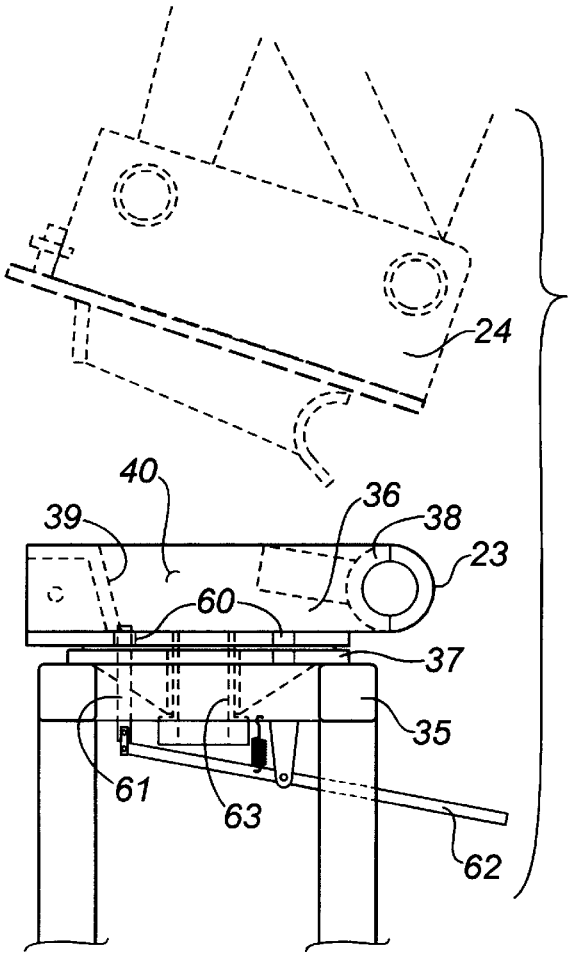
FIG. 5b
FIG. 6b
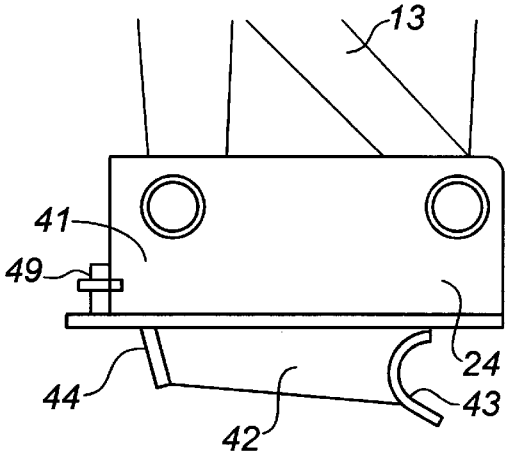

APPARATUS AND METHOD FOR EXTRACTING AND REPLACING BURIED PIPE

FIELD OF THE INVENTION

The present relates to apparatus and method for the simultaneous extraction of old buried pipe and the insertion of new pipe. A pipe pushing/pulling device is operable within a pit and is removably attached to and stabilized by the pit-excavating machine. The method comprises using the excavating machine to excavate the pit; anchor the device and power the device to pull out the old pipe and draw in the new pipe.

BACKGROUND OF THE INVENTION

As underground pipe ages or otherwise becomes inadequate for its purpose, there is a need to replace it with new pipe. Preferably, pipe replacement is performed with minimal impact to the surrounding environment, be it the disruption of normal traffic or the ground area needed to operate the equipment. Further, it is preferable to minimize the time expended setting up and repositioning the equipment used to conduct the pipe replacement.

Apparatus and process exist which meet several of the above goals with varying degrees of success. Minimizing the disruption of traffic is accomplished with a method for replacing pipe without digging a trench along the entire length of pipe.

Prior art processes comprise:

digging two pits into the ground to expose the old pipe;

fishing a cable through the old pipe;

using an abutting member to brace the cable against one end of the old pipe;

placing apparatus in the other pit and using shoring timbers to support the apparatus against the pit wall and absorb reaction forces;

pulling on the cable end and abutting member to pull the pipe from the ground and extract it from the pit; and optionally, attaching new pipe to the old pipe so as simultaneously pull new pipe into the bore through the ground formed by the extracted old pipe.

The above process has been accomplished with a variety of equipment which applies many or all of the above method steps. Apparatus including that in U.S. Pat. No. 5,328,297 ('297) to Handford and 5,211,509 to Roessler disclose various forms of cable-winches and pulley arrangements comprising:

a reaction plate for pressing or bracing against the side of the first pit's wall adjacent the first end of the old pipe for absorbing reactive forces generated through pulling of the pipe;

a pulley mounted to the reaction plate for receiving the pipe-pulling cable extending out of the pipe and turning it through a right angle to extend up and out of the first pit;

a structure extending up from the reaction plate to a cable winch; and the winch being attached to a moveable vehicle for enabling inserting of the reaction plate and connecting structure into the first pit.

The reaction plate of Roessler is a permanent non-rotatable structure attached to the vehicle. The rigid structure of Roessler holds the reaction plate stable but restricts the positioning of the vehicle to a position directly in-line with and opposing the pipe. Further, a separate piece of equipment must be provided to dig the pits.

Handford '297 provides an assembly which comprises a cable winch, a downward extending leg assembly, pulley and reaction plate. The assembly is releasably attached at ground surface to a front end loader for using its hydraulic power system. The reaction plate is rotatable relative to vehicle so that the vehicle may positioned anywhere around the pit. The leg assembly permits vertical adjustment to match the reaction plate's depth to the exposed pipe. The reaction plate of Handford is dependent however upon the pit wall being square to the normal force applied to pull the pipe. If the pit wall is not square, the reaction plate will rotate on the leg, mis-aligning the cable pulley from the pipe and adversely affecting the vertical. As with Roessler, a separate piece of equipment must be provided to dig the pits.

The prior art deals with non-square pit walls by using shoring. Personnel enter the pit and arrange a variety of timbers to square the reaction plate to the pit walls. Release of cable-pulling tension can dislodge or release the shoring, causing it to lose its stacked structure which then requires time-consuming repositioning by the personnel. Further, for safety reasons, use of personnel working in the pit should be minimized.

Neither Handford '297 nor Roessler teach nor suggest how a pulling apparatus may be constructed for permitting the equipment to be positioned closely adjacent and freely about the pit while also conveniently stabilizing the apparatus against the pit wall without involving personnel in a significant way or eliminating the troublesome shoring.

Another difficulty associated with old buried pipe is that in some instances it is necessary to initially free the pipe before it is possible to use a cable to pull the pipe from the ground. Accordingly, there is often a need to first loosen the pipe prior to pulling with the cable. One method of loosening a stuck pipe is to alternately push, then pull the pipe. This is not possible either with the prior art cable pulling apparatus described above as they do not incorporate a pushing reaction plate or means for generating a pushing force.

In another approach disclosed by Handford in U.S. Pat. No. 5,205,671 ('671), a hydraulic pushing device is provided which pushes old pipe out of the ground using a hydraulic ram. The rams can also pull the old pipe from the ground. A pulling pipe is extended through the old pipe and an abutment member is used to bear against the distal end of the old pipe. New pipe is bolted to the abutment member and is pulled into the ground as the old pipe is drawn or pushed out. Handford '671's device is fitted with reaction plates on both ends but is otherwise unsupported. Accordingly, the device is long and must be shored against the pit walls to prevent unwanted reactive movement.

There is a therefore demonstrated a need for apparatus capable of independent positioning about the pit and having sufficient structural strength to brace the pulling apparatus against the pit wall without reactive movement. Significant advantage in time and cost is achieved if the above can be achieved without shoring and by using a single prime-moving piece of equipment upon which the pulling apparatus can be quickly substituted with a pit-digging or pulling implement. It is advantageous if such an apparatus has the ability to break a stubborn pipe free from the ground.

SUMMARY OF THE INVENTION

Apparatus and method are provided which are used to extract a length or section of old buried pipe exposed at its ends by a pair of spaced apart pits. The apparatus disclosed herein reduces both the number of items of equipment required and the size of the pit in which the pulling equipment is located while also increasing the speed at which old pipe can be extracted. The apparatus further has the ability to loosen stuck pipe and insert new pipe while the old pipe is being extracted.

In accordance with one embodiment of the invention, there is provided:

a mobile excavator (such as a backhoe) having an articulated boom having a tool end;

a heavy box-like frame which is positioned in a first of the two pits;

the frame contains and supports an actuator, preferably one or more double-acting hydraulic cylinders, for axially pulling or pushing the length of old pipe through the ground;

the frame and boom tool end each have elements of a quick-attach coupling, the elements being operative to engage to lock the tool end and frame together, so that the boom may emplace in or remove the frame out of the pit and so that the excavator may be rigidly connected to the frame to anchor it and prevent it from twisting when pulling pipe;

preferably the coupling being operative to swivel although it can be pinned to prevent swivelling when appropriate;

a reaction plate structure, preferably detachable, which is connected with the frame, for bearing against the pit wall during pulling;

and a pulling member, preferably comprising a series of short segments (such as cables or rods) joined end to end by separable joints, the pulling member having means such as a plate abutting the end of the old pipe length at the second pit, said pulling member extending through the bore of the old pipe length into the first pit;

the actuator being connected to the pulling member for pulling it and the old pipe length.

By providing the aforesaid combination, the following advantages can be realized:

by the addition of providing a bucket with a quick-attach element, a backhoe can be used to excavate the pits, to move the frame into and out of the first pit, to operate the actuator, and to anchor the frame, thereby accelerating the pipe removal operation relative to what was commonly practised in the past in this connection, using a minimal number of pieces of equipment to do the work;

by providing an anchored frame, the time-consuming operation of shoring the pit with timbers has been eliminated;

the frame provides a rigid immovable connection between the cylinder and the reaction plate, thereby ensuring that the assembly does not twist;

by providing a separate, disengageable, movable reaction plate structure in conjunction with a hydraulic cylinder actuator, the assembly can be converted quickly between pipe pulling and pipe pushing modes. Having both modes available improves the versatility of the system.

Once pulling is established and the force required to pull the pipe falls off, the frame can be quickly decoupled and a ripper tooth can be coupled to the boom for utilizing the full range of boom motion to rapidly pull lengths of old pipe from the ground. As previously stated, if the pipe is stuck in the ground, the actuator is-operable also to push the pipe. For enabling the push capability, the single reaction plate structure is movable to the other end of the frame for bearing against the opposing wall of the pit. Additional versatility and scope is provided by providing a swivel between the boom's tool end and the frame. The swivel permits alignment of the old pipe and the frame's actuator while allowing the excavator to be positioned anywhere about the periphery of the extraction pit.

In a preferred aspect, the frame is attached to the tool end of the boom with a quick-attach coupling compatible with at least one other tool such as an excavator bucket. In a further preferred aspect, a swivel is incorporated between the frame and the tool end for permitting independent positioning of the frame and the excavator and thus permitting the excavator to be positioned anywhere about the periphery of the pipe-extraction pit.

In another preferred aspect, a tubular pig is used to enable simultaneous insertion of new pipe while the old pipe is being replaced. It is understood that the pig can be used with the above novel apparatus or conventional apparatus. The pig replaces the extraction cable's abutment and the old pipes second end and comprises:

a tubular member;

a connector at the leading end of the tubular member for attaching to the extraction cable extending from the old pipe;

a connector at the trailing end of the pig and inset therein for attaching to an insertion cable extending through the new pipe;

means for abutting the insertion cable's pulled-end against the new pipe's far end so that when the extraction cable is pulled, the pig is pulled, the old pipe is urged from the ground, the pig pulls the insertion cable and the new pipe is urged into the ground, the leading end of the new pipe being protected from debris as it is inset within the pig.

The apparatus above lends itself to a novel method of extracting old pipe, and in a further aspect, a novel method of simultaneously inserting new pipe while extracting the old pipe. More particularly, in a broad aspect the method comprises the steps of:

providing an excavator having a movable boom and a tool end having quick-connection to two or more tools including an excavating bucket;

installing the excavating bucket and digging first and second pits to expose a first and second ends of the old pipe;

extending an extraction cable through the old pipe, having a pulling end and a pulled end, an abutment member securing the pulled end against the second end of the old pipe;

substituting the excavating bucket with a pipe-pushing/pulling frame, the frame having a cable-pulling actuator and a reactive face plate;

positioning the frame into the first pit with the cable-pulling actuator aligned with the old pipe and then arresting movement of the boom so as to substantially prevent movement of the tool end relative to the vehicle;

connecting the cable-pulling actuator to the pulling end of the extraction cable extending from the first end of the old pipe;

actuating the cable-pulling actuator to pull the extraction cable and induce the pulled end of the extraction cable and the abutment member to push on the second end of the old pipe and extract the old pipe from the ground while the pipe-pushing/pulling frame is supported against reaction forces firstly by the reaction face plate bearing against the pit wall and secondly by the arrested boom preventing twisting.

In a preferred aspect, the method further comprises inserting new pipe simultaneously with the extraction of the old pipe by:

providing an insertion cable extending through new pipe and a new-pipe abutment member, connected to the pulled-end of the insertion cable and abutting against the new pipe's trailing end substituting the old-pipe abutment member with a tubular pig having first and second ends the pig's second end receiving the leading end of the new pipe, an old-pipe abutment member at the pig's first end, a first extraction cable-connector located at the pig's first end, and a second insertion cable-connector located within the bore of the pig's second end;

connecting the cable-pulling actuator to the pulling-end of the extraction cable extending from the first end of the old pipe, connecting the pulled-end of the extraction cable to the pig's first cable-connector and connecting the pulling-end of the insertion cable to the pig's second cable-connector;

actuating the cable-pulling actuator to pull on the extraction cable to pull the pig through the ground to simultaneously extract the old pipe and insert new pipe, the leading end of the new pipe being protectively housed within the bore of the member's second end.

BRIEF DESCRIPTION OF THE DRAWINGS

FIG. 1 is a diagrammatic view of the one embodiment of the present invention showing a pusher/puller apparatus connected to the boom of an excavator. The apparatus is poised to pull old pipe out of the ground and pull new pipe in;

FIG. 2*a* details the reaction plate structure which is shown exploded from the actuator shown in FIG. 2*b;*

FIG. 5*a* is a top view of the quick-attach coupling of the pusher/puller illustrating the coupling mount and swivel indexing holes;

FIG. 5*b* is a side view of the coupling of FIG. 5*a* illustrating the indexing lever and the boom part of the mount in phantom lines prior to engagement;

FIG. 6*a* is a bottom view of the boom mount of the quick-attach coupling;

FIG. 6*b* is a side view of the boom mount of FIG. 6*a;*

FIG. 7*a* illustrates use of the bucket to excavate the pits. FIG. 7*b* illustrates the use of the pusher/puller boom-stabilized within the pit for extracting old pipe. Lastly, FIG. 7*c* illustrates the use of a ripper tooth to rapidly extract loosened pipe from the ground;

DETAILED DESCRIPTION OF THE PREFERRED EMBODIMENT

Figure 1:
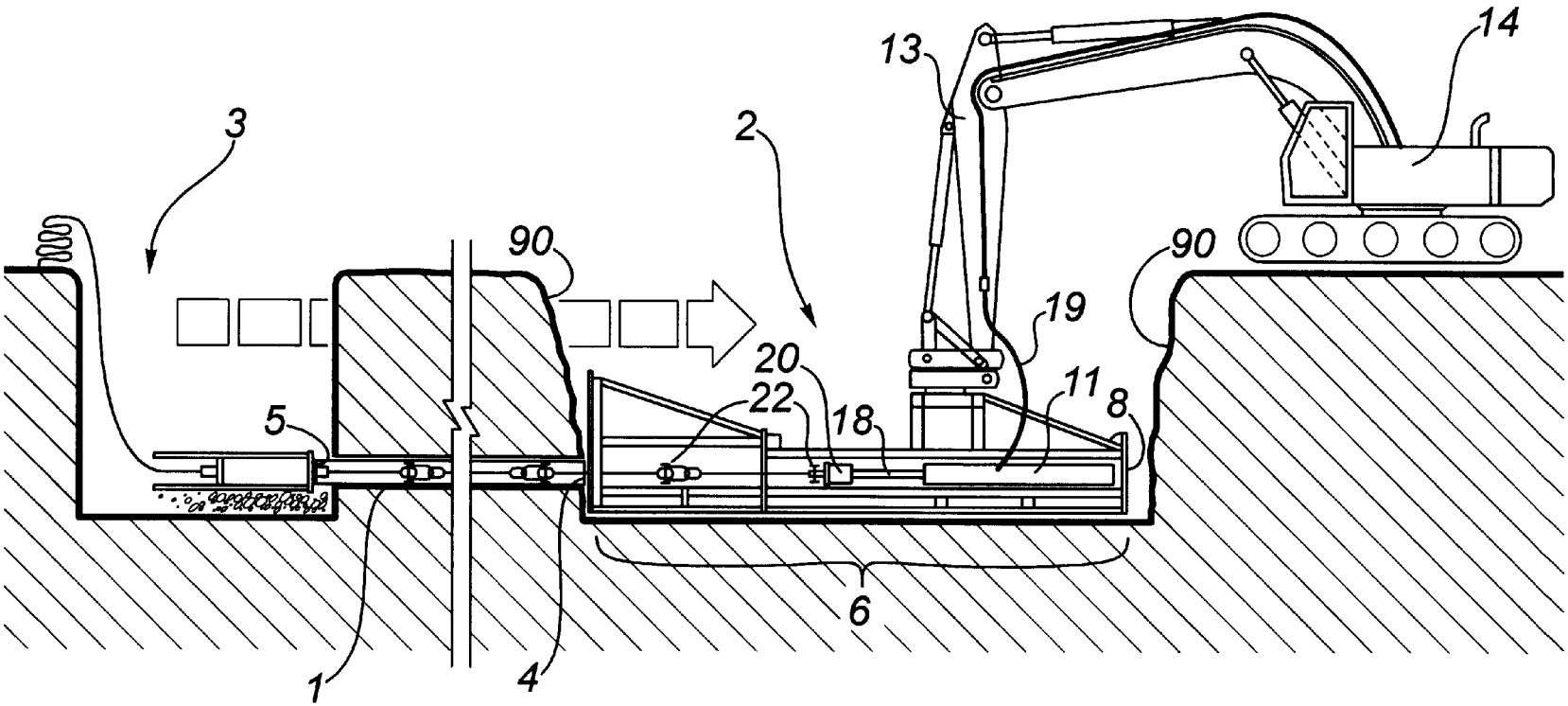
Figure 2B:
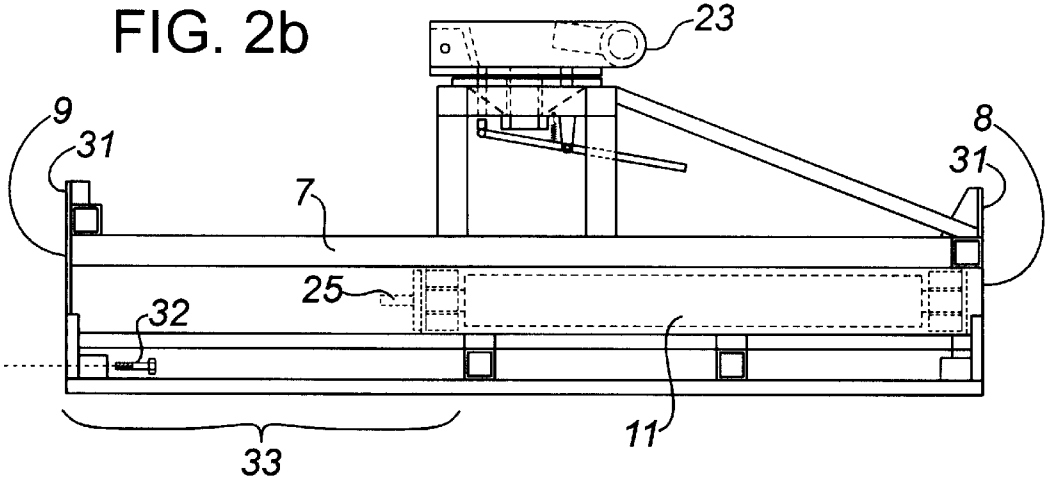
FIGS. 2*a* and 2*b* are side views of the in-ground portion of the pusher/puller apparatus.
Figure 2A:
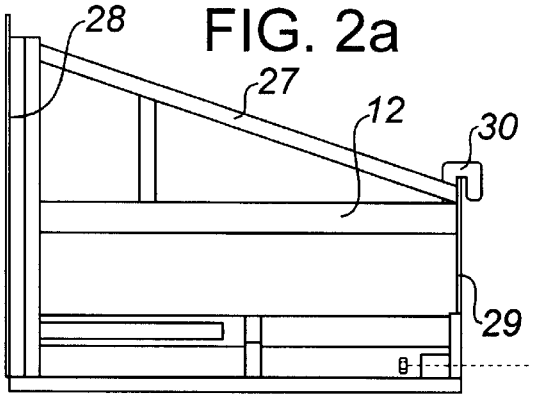
Figure 3B:
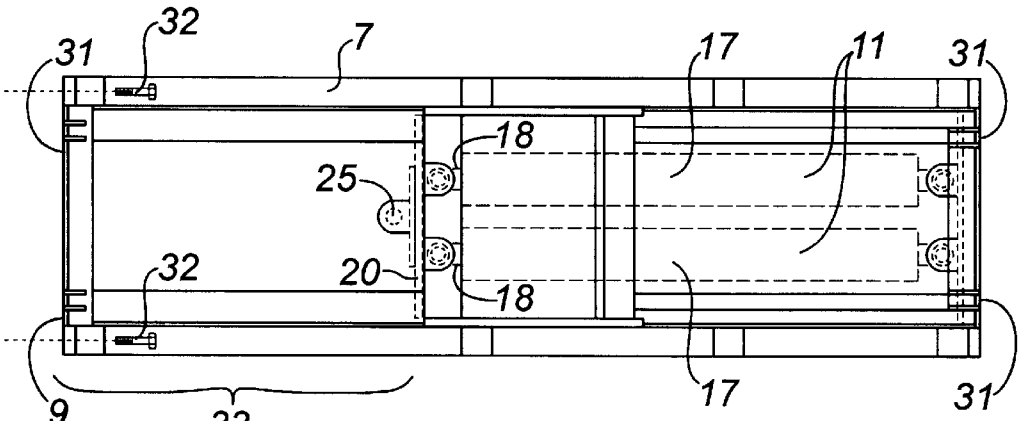
FIG. 3*a* and 3*b* are top views of the in-ground portion of the pusher/puller according to FIGS. 2*a* and 2*b;*
Figure 3A:
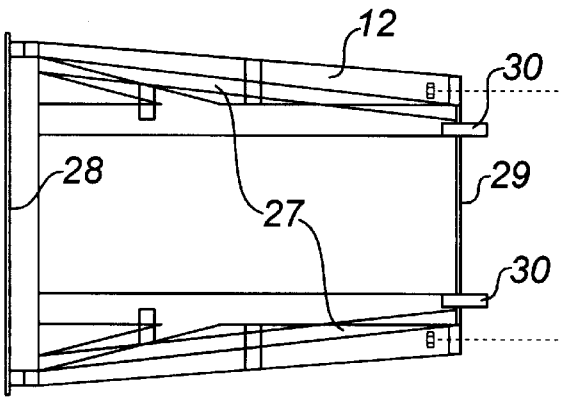

Having reference to FIG. 1, a buried old pipe 1 is shown which requires replacement. A first pipe-extraction pit 2 and a second pipe-insertion pit are located at spaced-apart locations along and to access the old pipe. The old pipe 1 is cut within the pipe extraction pit 2 to form a first end 4. The pipe is cut in the insertion pit 3 to form a second end 5.

Pusher/Puller 6

A pipe-pusher/puller 6 is provided for loosening and extracting the length of old pipe 1 from the extraction pit 2. The pusher/puller 6 is attached to the tool end 10 located at the distal end of the articulated boom 13 of a vehicle such as a mobile excavator 14.

The boom 13, in a first mode, is laterally and vertically movable for positioning and orienting the tool end 10 into and out of the pits 2,3 and once positioned, in a second mode, the boom 13 is rendered rigid for substantially arresting relative movement between the tool end 10 and the excavator 14. The boom is hydraulically operated and when the boom is not being physically manipulated, the boom's articulated joints and tool end are rigid relative to the excavator proper. Typically, when arrested, the boom is rigid enough to cause the excavator to move when force is applied to the tool end, thus bringing the excavator's weight to bear as resistance.

Preferably, the pusher/puller 6 is removably mounted to the tool end 10 with a quick-attach coupling 24 which permits the one vehicle 14 to be used for more than one purpose, namely to permit quick substitution of the pusher/puller 6 with optional tool attachments such as a bucket 15 (FIG. 7*a*—used to dig the pits 2,3) or the ripper tooth 16 (FIG. 7*c*—used to rapidly pull loosened old pipe 1 as described later).

Referring also to FIGS. 2*a*, 2*b*, 3*a* and 3*b*, the pipe pusher/puller 6 comprises four main parts: a frame 7 having a pushing end 8 and a pulling end 9; one-half of the quick-attach coupling 24 atop the frame 7 for attaching the frame to the tool end of the boom 13; a power-unit or actuator 11 mounted within the frame 7; and a detachable reaction plate structure 12 for positioning at either of the pushing or pulling ends 8,9. Only one reaction plate structure 12 is provided so as to minimize the overall assembled length of the pusher/puller 6 and thus minimize the required size of the extraction pit 2.

The motive power for extracting old pipe 1 is provided by the pusher/puller's actuator 11. The actuator 11 comprises two 5 foot long, 6" double-acting hydraulic cylinders 17, each having a piston (not shown) driving a 2½" ram 18. The cylinder's rams 18 are powered through hydraulic coupling with the excavator's hydraulic system 19. The ends of the two rams 18 are connected to a common abutment or ram plate 20.

In a pushing mode, the ram plate 20 bears against the end of the old pipe 1. Pushing is accomplished through extension of the rams 18. The full fluid area of the ram's piston is available to generate a large pushing force, greater than that available during pulling (reduced due to the ram's cross-section).

The ram plate 20 has an eyelet 25 for connection to a pulling cable 26 when in a pulling mode. Pulling is accomplished through retraction of the rams 18. Pulling force is less than pushing force due to the piston area loss by the ram.

Pipe pushing and pulling reactive forces are conducted through the ends of the cylinders 17 connected to the frame 7. The frame 7 conducts reaction forces into the reaction plate structure 12.

The reaction plate structure 12 comprises a load-supporting frame 27 having a bearing plate 28, for engaging the wall 63 of the pits 2,3 and a mounting end 29 having means for connection to the frame 7. A pair of spaced "L"-shaped hooks 30 at the mounting end 29 hook onto connection plates 31 at either the pushing and pulling ends 8,9 of the frame 7. Two, laterally spaced-apart bolts 32 secure the bottom of the reaction plate structure 12 to the frame 7.

The frame 7 has a longitudinally-extending open bottom 33 partially along its axis from the pulling end 9, so as to permit the frame 7 to lower over and straddle the old pipe 1 extending into the first extraction pit 2.

The Quick-Attach Coupling 22

Figure 4:
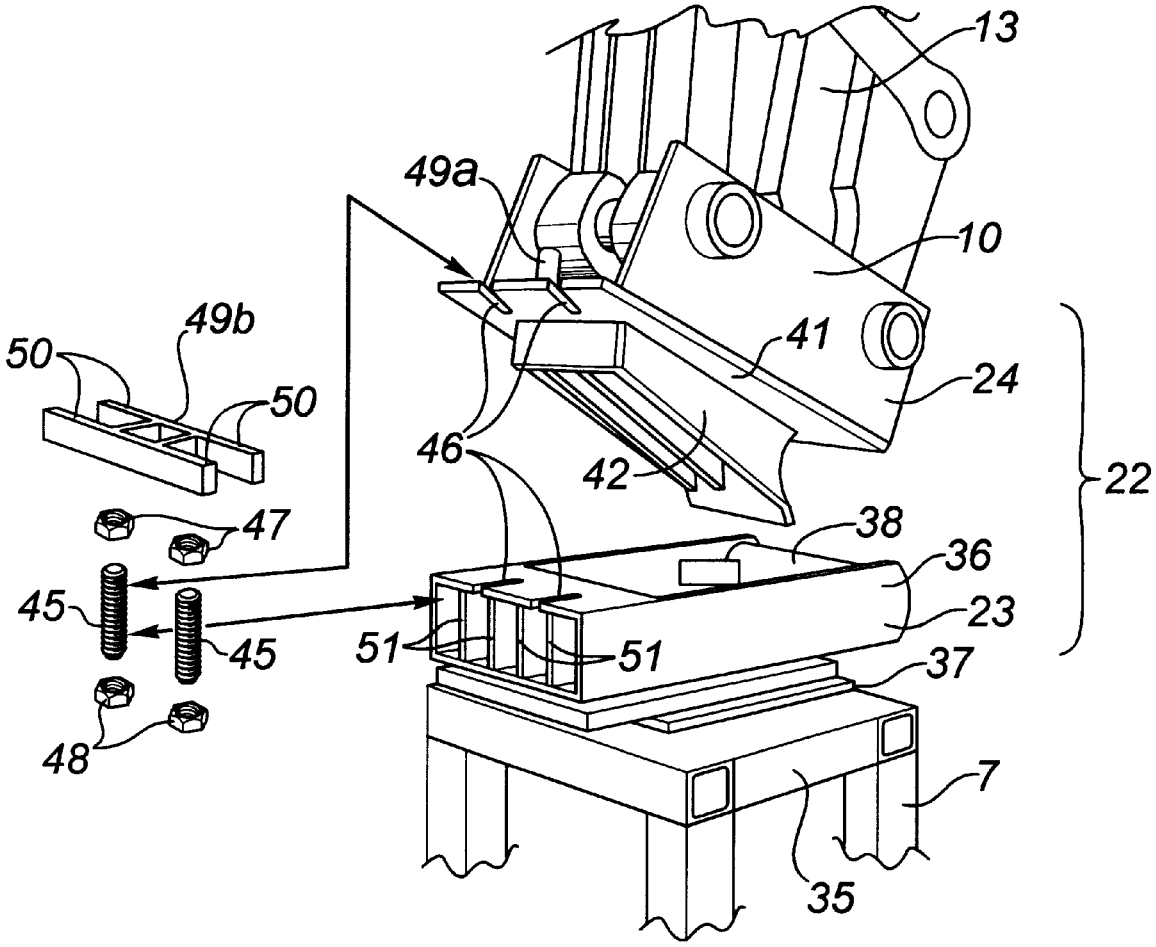
FIG. 4 is an isometric view of the quick-attach coupling of the pusher/puller apparatus prior to engagement. The coupling locking means is shown in exploded form.

The quick-attach coupling 22 has frame and boom mounts 23,24. As shown in FIG. 4, in a detached condition, the frame mount 23 of the quick-attach coupling 22 is secured to the frame 7 or pusher/puller 6. The boom mount 24 of the quick-attach coupling 22 is secured to the tool end 10 of the boom 13. The frame mount 23 is formed as a female mount for connection with the complementary male boom mount 24.

The female frame mount 23 comprises a first base 35 connected to the frame 7, an engagement housing 36 and a swivel 37 therebetween.

Also shown in FIGS. 5*a*,5*b*,6*a* and 6*b* the engagement housing 36 comprises an engagement fulcrum 38 opposing a first angled pinch plate 39. A cavity 40 is formed between the fulcrum 38 and the first pinch plate 39 for accepting the male boom mount 24.

The male boom mount 24 comprises a second base 41 for connection to the boom's tool end 10 and a protrusion 42 depending from the second base 41. The protrusion 42 has a lip 43 and a second angled pinch plate 44.

During connection (FIG. 4 and 5*b*), the protrusion 42 engages the engagement housing 36. The first and second pinch plates 39,44 slidably engage, driving the protrusion's lip 43 laterally into tight engagement with the housing's fulcrum 38, thereby ensuring no relative movement between the male and female mounts 23,24.

The male and female mounts 23,24 are locked together once engaged. A pair of bolts or studs 45 engage matched slots 46 formed in the first and second bases, 35,41, and in the engagement housing 36 (FIG. 4). Upper nuts 47 and lower nuts 48 sandwich and lock the protrusion 42 to the engagement housing 36. A pin 49*a* extends upwardly from the protrusion's base 41. A ladder bar 49*b* (having two rungs and four legs 50) is slipped over the pin with a pair legs 50 engaging the sides of the upper nuts 47 to prevent nut rotation, loosening and accidental loss of the studs 45. Strengthening ribs 51 in the structure forming the engagement housing 36 similarly serve to engage and prevent rotation of the stud's lower nuts 48.

Illustrated best in FIGS. 5*a* and 5*b*, the swivel 37 enables rotation between the engagement housing 36 and the female mount base 35. While the rotation is only in one plane (azimuthal), manipulation of the boom also permits pitch and roll to be adjusted. Complementary, facing and matched indexing holes 60 (8 shown) are formed in both the engagement housing 36 and the base 35. An index locking pin 61, operated using a spring-biased locking lever 62, engages and disengages from the aligned index holes 60 to alternately lock or permit free rotation of the engagement housing 36 relative to the base 35. The spring-bias causes the pin 60 to engage aligned and facing indexing holes. The engagement housing 36 rotates on a pivot 63.

In other words, when the indexing holes 60 are locked, the pusher/puller 6 cannot rotate relative to the excavator's boom 13.

In short, the quick-attach coupling 22 enables rapid and secure connection of the pusher/puller 6 and accessories 15,6,16 (FIGS. 7*a*,7*b* and 7*c* respectively) to the boom 13. Once locked, the quick-attach coupling securely holds the pusher/puller 6 against a twisting movement encompassing any of azimuth, pitch or roll.

From the foregoing it will be understood that each of the tool end and the frame have elements of the coupling secured thereto, the elements being operative to detachably engage to lock the tool end and frame together.

Operation—Extraction Of Old Pipe

Figure 7A:
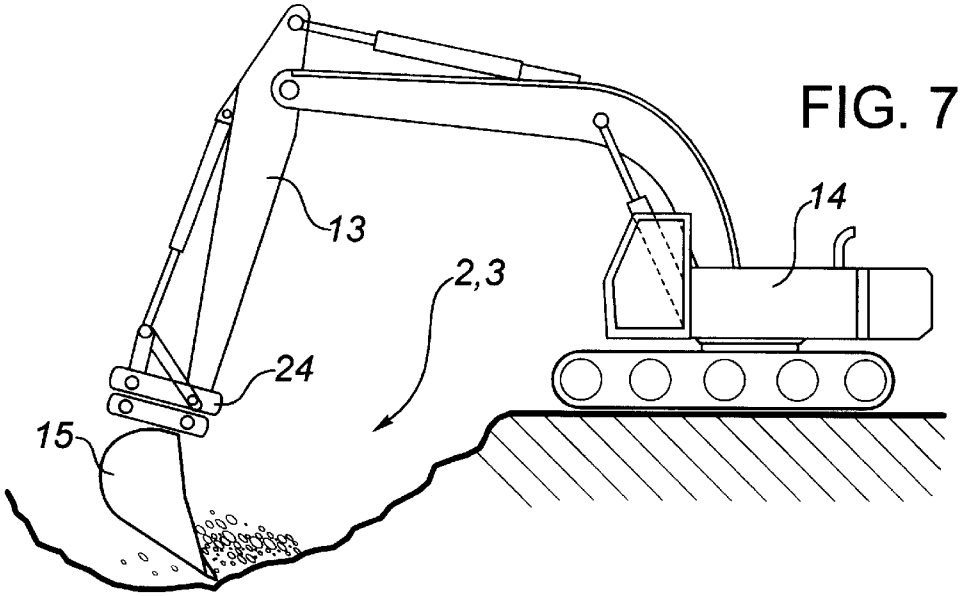
FIGS. 7*a*–7*c* illustrate the various operations which are performed in quick succession due to the quick-attach coupling. More specifically.
Figure 7C:
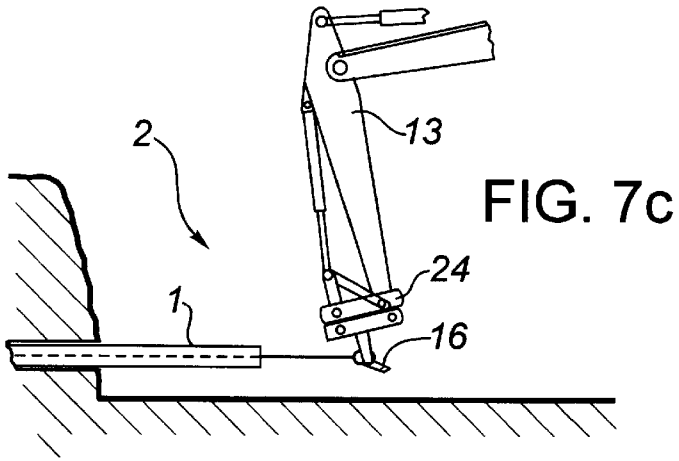
Figure 7B:
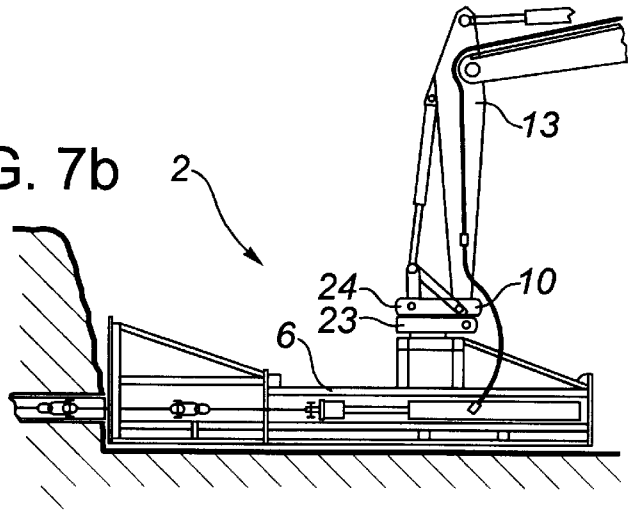

In a first embodiment of the method of the invention, in operation, the bucket 15 is attached to the boom's tool end 10 (FIG. 7*a*). Pipe-extraction and pipe-insertion pits 2,3 are dug at each end of the old pipe 1 to expose the old pipe. The exposed pipe is cut. The excavated length of the extraction pit 2 is equal to greater than the combined length of the frame 7 and the reaction plate structure 12. If physical access about the extraction pit 2 is limited, the excavator 14 can be positioned atop any excavated soil about the periphery of the pit 2. If access to one side of the extraction pit 2 is blocked, the quick-attach coupling 22 enables full independent 360 degree indexed rotation of the pusher/puller 6. Accordingly, the excavator 14 can be located anywhere about the pit 2. The index locking holes 60 and pin 61 lock the rotational positioning of the pusher/puller 6.

Once the pits 2,3 are dug, the bucket 15 is then detached and the pipe pusher/puller 6 is connected to the male mount 24 of the boom's tool end 10. The actuator 11 is connected to the excavator's hydraulic system 19 with quick-connect hose couplings. The boom 13 is manipulated to lower pusher/puller 6 into the pipe-extraction pit 2.

Figure 8:
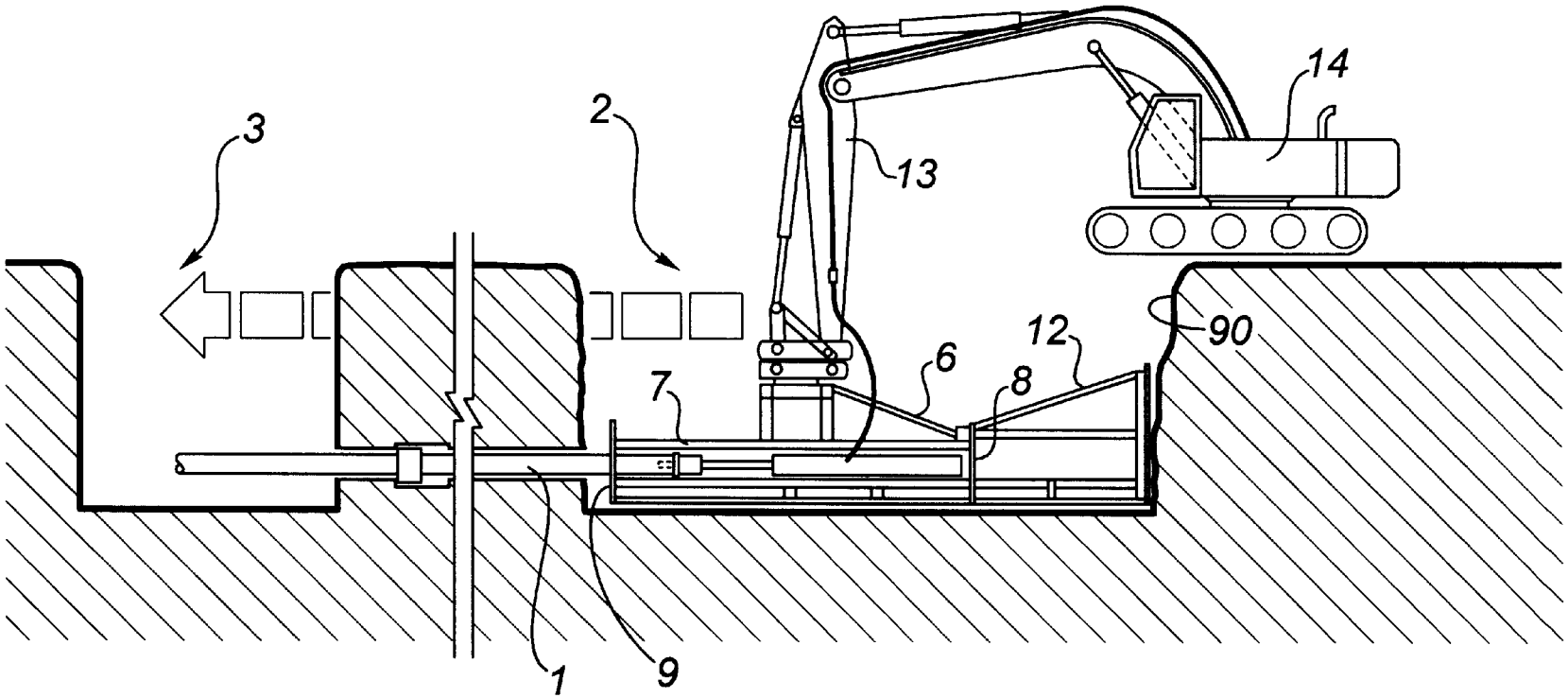
FIG. 8 illustrates the pusher/puller apparatus of FIG. 1 in the process of pushing the old pipe for loosening it prior to pulling.

Ground can adhere to old pipe over time and it may be necessary to first dislodge or break the old pipe 1 free of the ground with the pusher action of the pusher/puller 6. If so required and as shown in FIG. 8, the reaction plate structure 12 is attached at the pushing end 8 of the frame 7. The pusher/puller 6 is placed into the pit 2 with the axis of the frame 7 substantially in-line with the old pipe 1. The frame's open bottom 33 straddles the old pipe's first end 4 with the ram plate 20 movement or actuation placed into co-axial alignment with the old pipe 1. The bearing plate 28 of the reaction plate structure 12 bears against the pit wall 90 opposite the first end 4 of the old pipe 1. The ram plate 20 engages the pipe's first end 4. Hydraulic pressure is applied to the cylinder 17, driving the rams 18 and ram plate 20. The old pipe 1 is pushed away from the pusher/puller 6 and is driven into the soil, thereby loosening it.

Reaction forces are transmitted through the bearing face 28 into the pit wall 90 opposing the old pipe. If the pit wall 90 is not square to the bearing plate 28, then pushing reaction forces cause the pusher/puller 6 to try to twist square. The boom 13 acts to hold the pusher/puller 6 square to the pipe 1, regardless of the condition of the bearing pit wall 90, and without using shoring or bracing. More particularly, while the bearing plate absorbs axial reaction forces, the boom 13 secures the pusher/puller 6 against twisting relative to the pit wall (preventing relative pitch/roll or azimuthal movement).

If the old pipe 1 is successfully loosened or was already loose, then the pusher/puller 6 is configured for pulling (FIG. 1,10). The boom 13 lifts the pusher/puller 6 free of the pit and the reaction structure 12 is attached to the pulling or ram plate end 9 of the frame 7.

Figure 9:
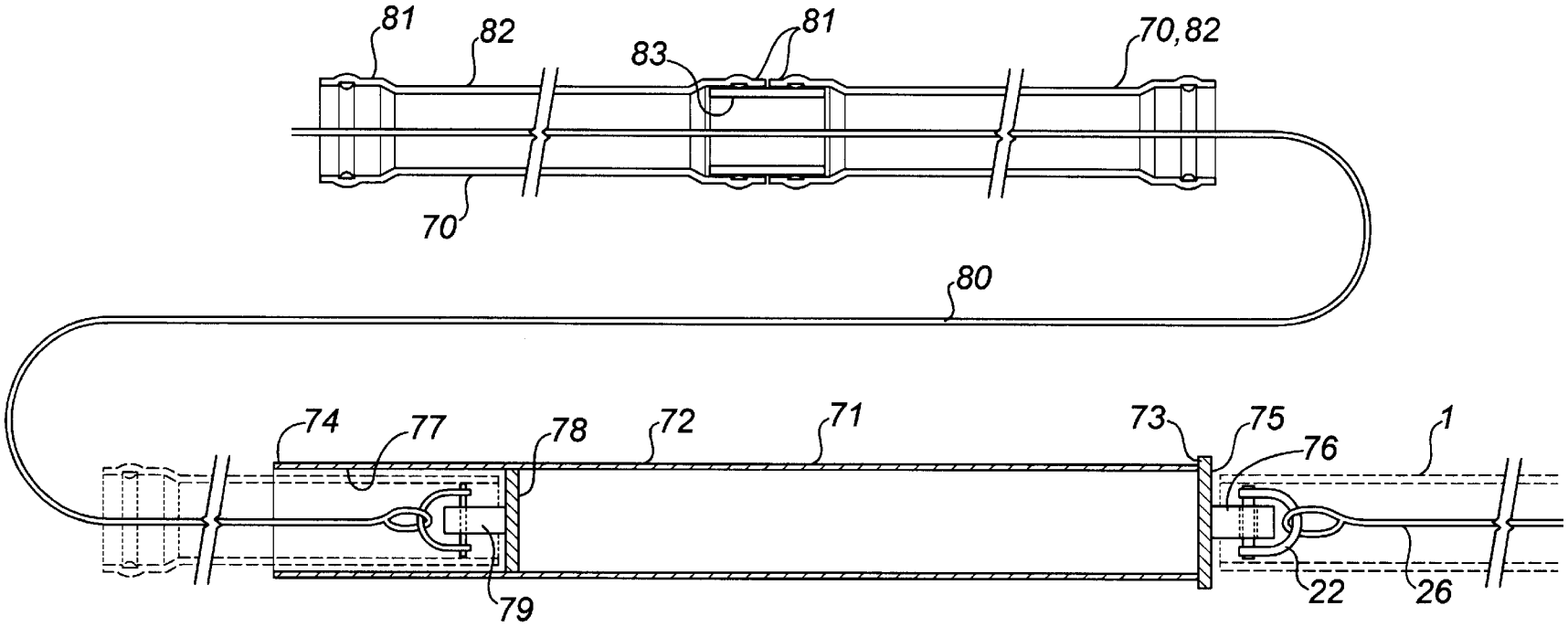
FIG. 9 is an exploded cross-sectional view of the new pipe-insertion pig and new double-belled pipe.

Having reference to FIG. 9, the pulling cable 26 is installed in the old pipe 1.

Initially, thin sectional rods (not shown) are progressively threaded together and pushed through the old pipe 1 until they protrude from the pipe's second end 5. One end of a light cable (not shown) is secured to the protruding rods at the old pipe's second end 5. The rods and end of the light cable are pulled back through the pipe's first end 5. The heavier segmented "pulling" cable 26 is attached to the other end of the light cable at the second pit 3. The light cable is pulled out of the old pipe 1 for drawing the pulling cable 26 through the old pipe 1 and into the extraction pit 2. A winch is usually required to pull the heavy pulling cable 26.

When rigged for pulling mode (FIGS. 7*b*, 10), the pusher/puller 6's quick-attach coupling 22 is manipulated to swivel the movement of the actuator 11 into alignment with the old pipe 1. The swivel permits the excavator 14 to be optimally positioned about the pit 2.

The pusher/puller 6 is lowered into the extraction pit 2 to straddle the old pipe's first end 4. The pulling cable 26 is connected to the eyelet 25 of the ram plate 20 with a clevis and pin 22. Short choker cables or a link (not shown) can be used to make up any gap between the end of the pulling cable 26 and the ram plate's eyelet 25.

Figure 11:
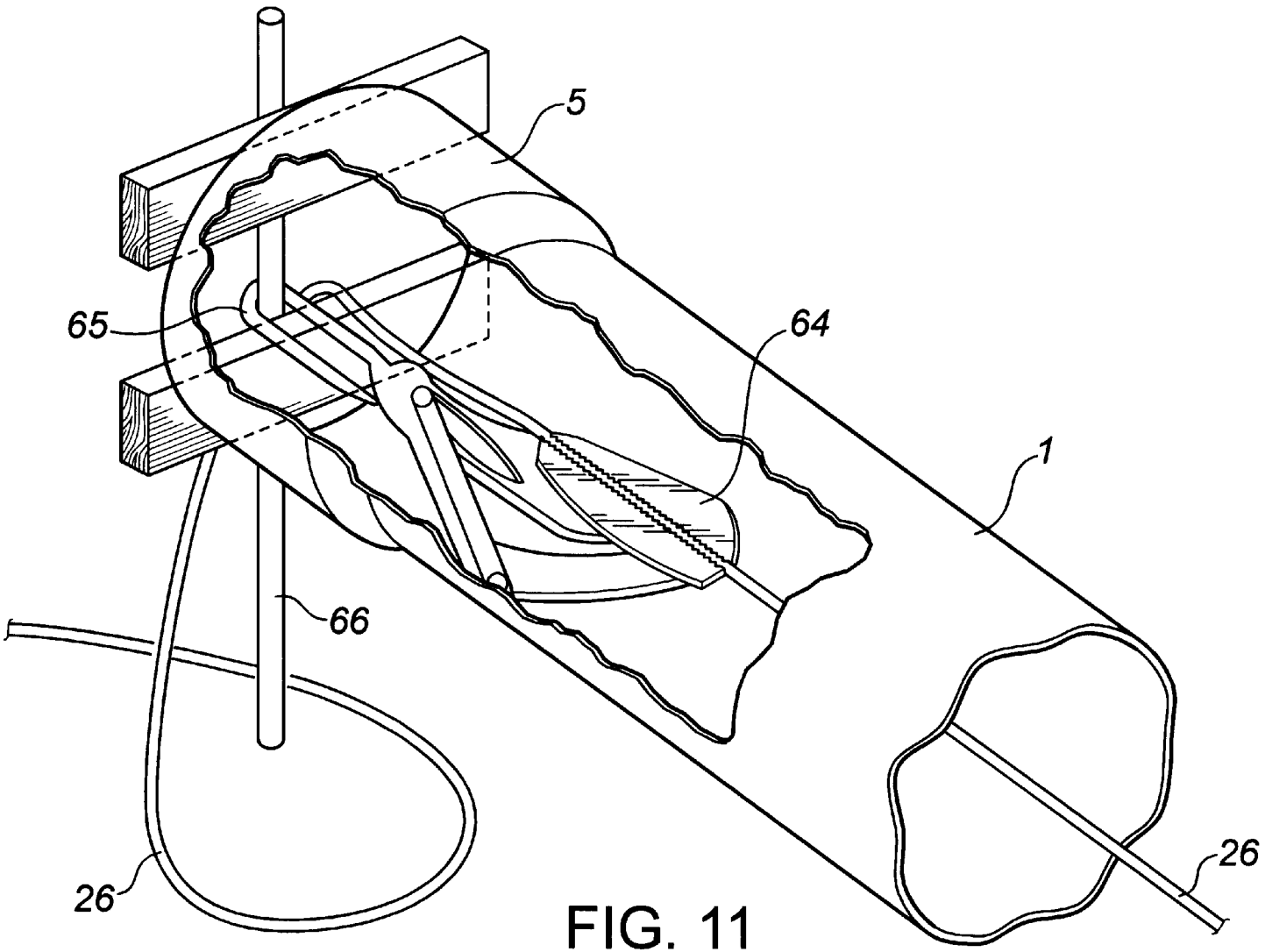
FIG. 11 is a perspective view of a pipe with a cable grip and bar set to urge the pipe through the ground.

At the second end 5 of the old pipe 1 in the insertion pit 3, a cable grip 64 (FIG. 11) is slid along the pulling cable 26 to the end of the pipe's second end 5 to secure the pulling cable 26. Such a cable grip is available as Klein Chigago™. grips, available from Wire Rope Industries, Edmonton, Alberta. The cable grip 64 has an eyelet 65. A bar 66 is inserted through the grip's eyelet 65 and extends transversely to bear against the pipe's second end 5.

The rams 18 and ram plate 20 are actuated to retract and tighten the pulling cable 26. Further retraction of the rams 18 pulls on the cable 26, pulling the bar 66 to abut against the pipe's second end 5 so as to push or force the pipe 1 out of the ground and into the extraction pit 2. For the specified rams 18, a hydraulic pressure of about 4000 pounds per square inch (psi) is maximum, greater forces usually causing unwanted deformation of the pin of the connecting clevis 22.

As the stroke of the rams 18 is exhausted, the cylinders are extended and the grip 64 is re-gripped to shorten the effective length of the pulling cable. The cycle of actuation and cable re-gripping is performed as often as necessary to pull the old pipe 1.

As was similarly described for the pusher operation, pulling reaction forces are transmitted through the bearing face 28 into the pit wall 90, this time adjacent the old pipe's first end 4. Once again, the boom 13 acts to hold the pusher/puller 6 against twisting, regardless of the condition of the bearing pit wall 90, and without using shoring or bracing.

Typically, when the hydraulic pressure necessary to pull the old pipe 1 drops to about 1000 psi, the old pipe 1 is suitably loose enough to pull it out with the boom 13 alone. Accordingly, great savings in time can be achieved.

More specifically, when the pipe is suitably loose, the pusher/puller 6 is removed from the pit 2. The pusher/puller 6 is de-coupled from the boom's quick-attach coupling 22. Means are then provided to directly connect to the pulling end of the cable, such as by a hook on the tool end of the boom or more preferably by quickly replacing the pusher/puller 6 and coupling a ripper tooth 16 to the tool end 10. The end of the pulling cable 26 is hooked over the ripper tooth 16 and the boom 13 is used to pull the old pipe 1 out of the extraction pit 2. The boom has a long range of motion and rapidly pulls the pipe 1. Discrete lengths of pulled old pipe 1 are removed from the pulling cable 26 as necessary and the cable is shortened for the next pulling stroke.

Operation—Simultaneous Insertion Of New Pipe

Figure 10:
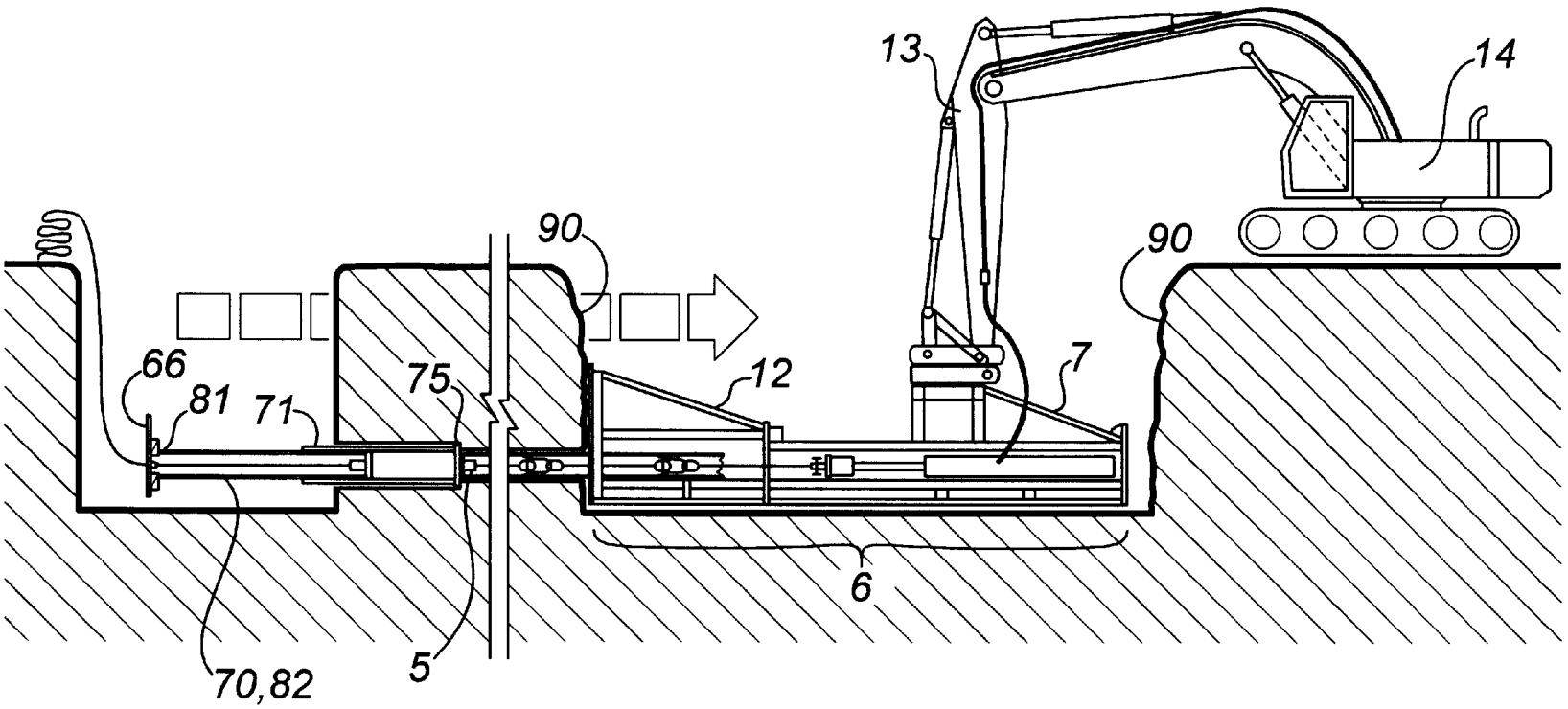
FIG. 10 illustrates the pusher/puller apparatus of FIG. 1 in the process of extracting old pipe and installing new pipe.

In a second embodiment of the method, new pipe 70 is inserted while the old pipe 1 is extracted (FIGS. 1 and 10).

Having reference also to FIG. 9, a pig 71 is utilized, placed at the second end 5 of the old pipe 1. During the pulling process, the pulling cable 26 pulls the pig 71 which in turn pushes the old pipe 1. The pig 71 follows and urges the old pipe 1 out of the ground and simultaneously enlarges the bore through the ground as the pig 71 progresses.

The pig 71 pulls new pipe 70 simultaneously into the ground behind the pig 71.

The pig 71 comprises a tube 72 having a leading end 73 and trailing end 74. A transverse member or plate 75 extends across the pig's leading end 73 and, at a minimum, is sized for bearing against the old pipe 1. Preferably the diameter of the pig 71 or the bearing plate 75 is sized to ream the ground behind the old pipe 1, forming a larger bore, and thereby aiding in installation of same-sized or larger diameter new pipe 70. A tongue 76 extends from the bearing plate 75 for connection to the pulling cable 26 with a clevis and pin 22. The pig's trailing end 74 has a bore 77 which is sufficiently large to accept the new pipe 70.

A pulling plate 78 is installed within the bore of the trailing end 74 of the pig 71. The pulling plate 74 has a tongue 79 for connection to a installation cable 80 for pulling new pipe 70, also with a clevis and pin 22. The pulling plate 78 is axially and inwardly offset from the trailing end 74 of the pig 71 so that the new pipe 70 extends into the pig 71. The installation cable 80 is threaded through a length or lengths of new pipe 70. The cable grip 64 and bar 66 retain the new pipe 70 in close relation with the pig 71. The cable grip 64 is set to ensure the leading end of the new pipe 70 does not come out of the pig's trailing end and thus prevents the entry of debris. As each new pipe 70 enters the ground, the cable grip 64 is released, another length of new pipe is added. The installation cable 80 is threaded through the new pipe and the cable grip 64 and bar 66 are reset.

Despite the reaming action of the pig 71, the new pipe 70 is still subjected to significant axial loads as it traverses the ground. Generally, conventional male/female belled pipe can be damaged as a male spigot end engages the bell end or bell. As shown in FIG. 9, a bell 81 has a radially diminishing profile as it approaches the main tubular portion of the pipe 70. Accordingly, when a spigot 'bottoms' within a bell (the leading edge of the spigot contacts the diminishing profile of the bell) it first imposes an axial load and then is urged to follow the profile radially inwardly, imposing ever greater radial forces sufficient to blow the bell apart.

Accordingly female/female or double-belled pipe 82 is used as the new pipe 70. An appropriately sized male/male nipple 83 is inserted between adjacent double-belled pipe 82. The nipple 83 engages facing bell ends 81 of the two new pipes 70. The diameter of the nipple 83 is obviously of a complementary diameter to sealaby fit into the bell ends 81 of the double-belled pipe 82. Further, the length of the nipple 83 is such that the bell end 81 of one length of new pipe 70 will butt up against the bell 81 of the adjacent new pipe 70 before the nipple 83 can 'bottom' out. Accordingly, the axial loads imposed during installation are borne axially by the bell/bell 81/81 contact and, neither the bell/bell contact nor the nipple/bell end contact 83/81 create damaging radial forces.

The above apparatus is capable of pulling old pipe and optionally installing new pipe in its place:

despite the old pipe being initially stuck in the ground;

with minimum disruption of the area surrounding the pits;

with minimal access requirements about the periphery of the extraction pit;

with minimal exposure of personnel in the pits;

without the need for shoring, bracing and the associated difficulties in maintaining them in place and maintaining the pulling apparatus square in the extraction pit and to the pipe being pulled;

while, as soon as possible, maximizing the rate of removal of old pipe as the force needed to pull the pipe reduces;

while minimizing the risk of damage of the new pipe; and with an overall and significant increase of the rate at which old pipe can be extracted and new pipe can be installed.

The embodiments of the invention in which an exclusive property or privilege is claimed are defined as follows:

1. A method for extracting an old pipe buried in the ground, comprising:

(a) providing a mobile excavator which has a movable boom having a tool end, said tool end having means for quick connection with an excavating bucket;

(b) connecting the excavating bucket to the tool end;

(c) digging a first pit in the ground with the excavator and excavating bucket to expose and make accessible a first end of the old pipe;

(d) digging a second pit in the ground with the excavator and excavating bucket so as to expose and make accessible a second end of the old pipe;

(e) inserting a segmented extraction cable formed of disengageable sections, said cable having a pulling end and a pulled end, through the old pipe and securing an abutment member to the pulled end for abutting the abutment member against the second end of the old pipe, whereby the pulling end of the extraction cable remains protruding from the first end of the old pipe;

(f) disconnecting the excavating bucket from the tool end and connecting a frame to the tool end, the frame having means for quick connection with the tool end quick connection means, said frame having a a hydraulic cylinder actuator mounted therein and a reaction plate structure;

(g) using the excavator boom to position the frame into the first pit with the hydraulic cylinder actuator aligned with the old pipe;

(h) arresting movement of the boom so as to substantially prevent movement of the tool end relative to the mobile excavator;

(i) connecting the actuator to the pulling end of the extraction cable extending from the first end of the old pipe;

(j) using a hydraulic system of the excavator to operate the hydraulic cylinder actuator to pull on the extraction cable to induce the abutment member and the pulled end of the extraction cable to bias the old pipe through the ground while the frame is supported against reaction forces firstly by the reaction plate structure bearing against the pit wall and secondly by the boom preventing twisting.

2. The pipe-pulling method recited in claim 1 wherein connection between the tool end and the frame is fitted with a swivel so that the mobile excavator is positional at a plurality of positions about the first pit independent of the frame so that the hydraulic cylinder actuator remains aligned with the old pipe.

3. The pipe-pulling method recited in claim 1 wherein the hydraulic cylinder actuator is capable of both pulling and pushing actuation so that when the actuator pushes, it pushes against the first end of the old pipe to loosen the old pipe within the ground and when the actuator pulls, the extraction cable is pulled for extraction of the old pipe.

4. An apparatus for extracting a discrete length of old pipe buried in the ground, the pipe length having first and second ends accessible through spaced apart first and second pits formed in the ground, comprising:

a mobile excavator having a movable articulated boom having a distal tool end;

a pulling member extending through the pipe length, said pulling member having pulling and pulled ends;

the pulling member having means at its pulled end for abutting the pipe's second end;

a frame positioned in the first pit;

a reaction plate structure connected with the frame and bearing against the wall of the pit, for transferring reaction to pulling force to the ground;

a quick-attach coupling rigidly connecting the boom with the frame, the coupling having a first element secured to the boom tool end and a second element secured to the frame, said elements being detachably engaged so that the excavator anchors the frame through the boom and coupling; and a cylinder assembly mounted within and to the frame, said cylinder assembly being connected with the pulling end of the pulling member, for pulling the pulling member to bias the length of old pipe toward the first pit.

5. The apparatus as set forth in claim 4 wherein:

the pulling member is segmented, being formed of sections disengageably coupled together end to end.

6. The apparatus as set forth in claim 5 wherein:

the cylinder assembly comprises at least one double-acting hydraulic cylinder for optionally axially biasing the old pipe toward or away from the first pit.

7. The apparatus as set forth in claim 6 wherein:

the frame is box-shaped, having first and second ends;

each end of the frame has means for detachably engaging the reaction plate structure; and the reaction plate structure has means for engaging the frame end means;

so that the reaction plate structure is detachable and optionally positioned at each end of the frame.

8. The apparatus set forth in claim 6 wherein:

the excavator has a hydraulic fluid system and the system is operatively connected with the hydraulic cylinder for powering it.

9. The apparatus as set forth in claim 4 wherein:

the coupling is operative to swivel.

* * * * *